United States Patent [19]

Campbell et al.

[11] Patent Number: 5,076,782

[45] Date of Patent: Dec. 31, 1991

[54] CONTROL DEVICE FOR A FUEL VALVE

[76] Inventors: Johnny E. Campbell, 4057 Vogt Rd., House Springs, Mo. 63051; James J. Briem, 712 Hanley Industrial Ct., St. Louis, Mo. 63144

[21] Appl. No.: 385,186

[22] Filed: Jul. 26, 1989

[51] Int. Cl.[5] ..... F23N 1/02; F16K 31/524

[52] U.S. Cl. ..... 431/89; 431/12; 251/254; 251/263; 251/291; 251/292; 74/568 R

[58] Field of Search ..... 431/12, 75, 76, 89, 431/90; 251/254, 263, 146, 291, 292; 74/568 R; 236/15 BD

[56] References Cited

U.S. PATENT DOCUMENTS

| | | | |
|---|---|---|---|
| 3,433,091 | 3/1969 | Jullian-Davin | 74/568 R |
| 4,150,939 | 4/1979 | Hayes | 431/76 |
| 4,439,138 | 3/1984 | Graig et al. | 431/12 |
| 4,629,157 | 12/1986 | Tsuchiya et al. | 251/292 X |
| 4,635,898 | 1/1987 | Rollins et al. | 251/251 X |
| 4,790,514 | 12/1988 | Marks | 251/291 X |

FOREIGN PATENT DOCUMENTS

| | | | |
|---|---|---|---|
| 742375 | 12/1955 | United Kingdom | 431/12 |

OTHER PUBLICATIONS

Cleaver-Brooks Model CB, Operation, Service And Parts Manual, 1975, pp. 1-3, 5-1, 5-2, 54-3, 5-13, 5-14 and 5-15.

Gordon-Piatt, Instruction Manual, p. 7305.

*Primary Examiner*—Carl D. Price

*Attorney, Agent, or Firm*—Gravely, Lieder & Woodruff

[57] ABSTRACT

A control device, which is interposed between a modulating motor and a valve, includes a control arm which is mounted on the shaft of the valve and a roller follower that is on the arm. In addition, the control device includes a bracket which is mounted on a fuel line adjacent to the valve, a cam which rotates on the bracket about an axis that is parallel to the shaft and an operating arm which rotates with the cam and is connected to the modulating motor, so that the modulating motor moves an air damper and cam in unison. The cam has an arcuate element which curves eccentrically about the axis of rotation and screws which are threaded into the arcuate element such that their ends form a cam profile. The roller follower bears against this profile, riding over the ends of the screws as the cam rotates. The screws on the cam are arranged in two rows, with the screws of one row being staggered with respect to those in the other, and this imparts a continuity to the profile, so that the roller does not pulsate as it moves along the profile.

15 Claims, 3 Drawing Sheets

CONTROL DEVICE FOR A FUEL VALVE

BACKGROUND OF THE INVENTION

This invention relates in general to the combustion of fluent fuels and more particularly to a control device for proportioning the amount of fuel to the amount of combustion air over a wide range of heat delivered.

Many large buildings and certain industrial processes utilize steam, which is produced in boilers, as a medium for transferring heat to remote locations. Within the typical boiler a combustible fuel, which may be a gas or a liquid, and air mix, and the mixture burns to produce the heat required for converting water to steam. The fuel flows into a combustion chamber within the boiler through a fuel line, whereas the air is forced into the combustion chamber by a fan. Because the demands on such boilers often vary, it is customary to have a control valve in the fuel line and a damper immediately beyond the fan, and to operate the two in unison with a single modulating motor. Thus, when the boiler receives a demand for more steam, the modulating motor opens the fuel valve and the air damper, so that the combustion within the boiler produces more heat—and the reverse holds true as well.

The efficiency with which a boiler operates at any setting depends to a large measure on the ratio of fuel to air within its combustion chamber. For example, it is desirable to have minimum excess of oxygen to prevent the formation of carbon monoxide and soot and yet to maximize efficiency. The more closely controlled the fuel to air mixture, the more efficient an excessive supply of oxygen causes much of the heat to be wasted merely elevating the temperature of the excess air.

Control devices exist which closely match the flow of fuel to the flow of air over a wide range of heat demands on a boiler, and these devices, to a measure, are adjustable so that at a particular damper setting for air flow, the fuel flow may be increased or decreased to achieve that proper air-fuel ratio at that setting. Typically, this type of control device has a cam along which a follower rides, the follower in turn being coupled to the fuel valve to control the amount of fuel admitted to the combustion chamber. The shape of the cam may be altered to achieve the precise control at the various setting throughout the heat range, and in several devices this alteration is effected by a series of set screws located along the cam. For example, in one control device, the cam surface, over which a follower rides, lies along a coil spring that is stretched over the ends of set screws, and indeed the ends of the screws are contoured to accommodate the cylindrical shape of the spring. By turning the screws, the shape of the spring—and likewise the profile of the cam—changes, but by reason of the contours at their ends, the screws must be turned in 180° increments. This detracts from the precision with which the adjustments are made. Furthermore, the spring only produces a convex profile throughout its length. It cannot provide concave segment in its profile, and where a concave segment is required for a particular burner setting, the burner must operate at less than optimum efficiency at that setting. Also, the spring is not very sturdy and must be replaced from time to time. Another control device utilizes a warp plate for its cam, with curvature of the plate being controlled by set screws. The plate does not easily accept changes in its contour and, furthermore, is subject to fracture.

The typical control device of current manufacture is designed for use on one type of furnace, generally as original equipment. Only with substantial and time consuming modifications—and considerable innovation as well—can it be applied to another furnace. Yet the fuel valves used with all furnaces are essentially the same.

The present invention resides in a control device for accurately proportioning the flow of fuel to the flow of air supplied to a combustion chamber so that the combustion within the chamber occurs under optimum conditions over a wide range of heat settings. The control device provides a camming surface over which a follower rides, and the follower operates a fuel valve. The contour of the camming surface is easily and precisely adjusted so that the proper amount of fuel enters the combustion chamber for any and all heat settings, and the adjustment permits a concave segment on the surface if necessary. The device mounts on the fuel line itself, next to the fuel valve, and may be fitted to a wide variety of heating devices with little effort. It is simple in design and durable in construction.

DESCRIPTION OF THE DRAWINGS

In the accompanying drawings which form part of the specification and wherein like numberals and letters refer to like parts where they occur—

DETAILED DESCRIPTION

Figure 1:
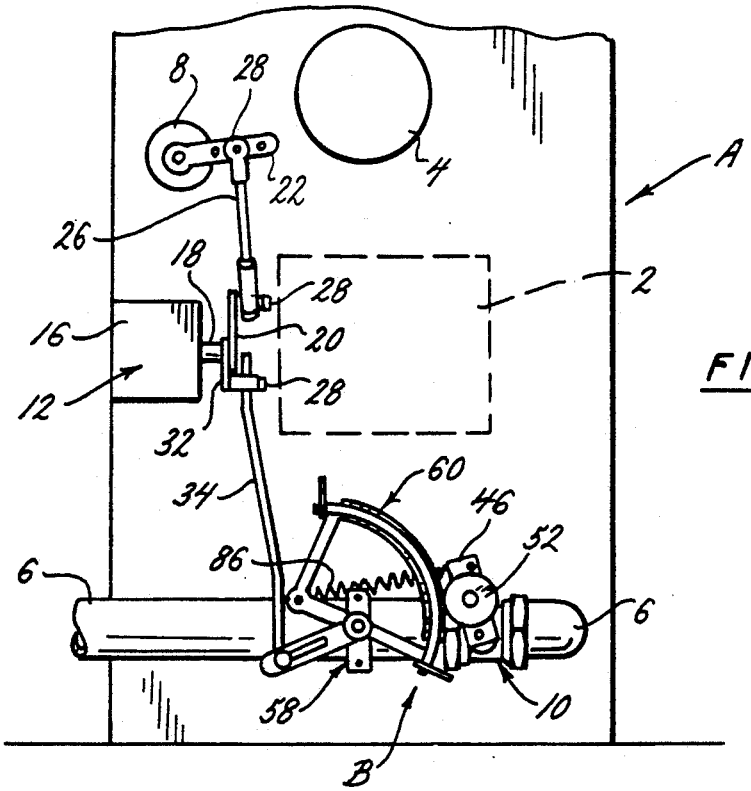
FIG. 1 is an elevational view of a boiler provided with a control device constructed in accordance with and embodying the present invention.
Figure 5:
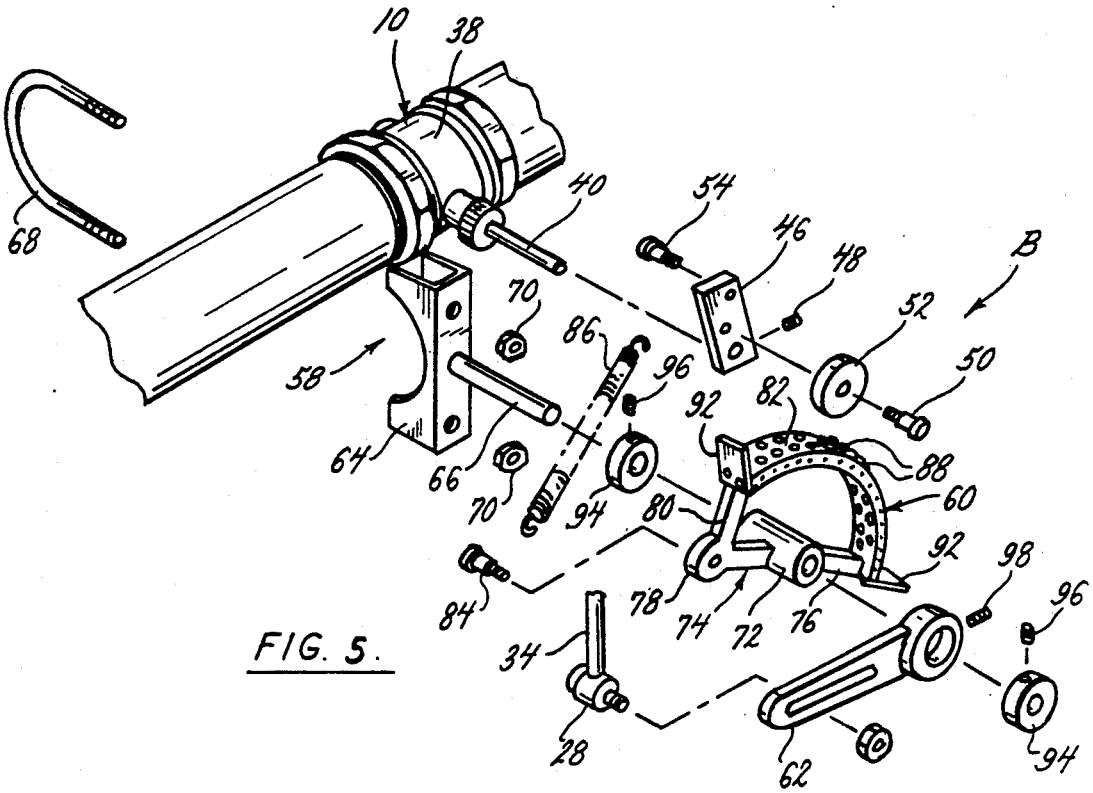
FIG. 5 is an exploded perspective view of the control device.

Referring now to the drawings, a boiler A (FIG. 1) for converting water to steam has a combustion chamber 2 into which an electrically-powered fan 4 introduces combustion air. Within the chamber 2 the air mixes with a fuel, such as natural gas, that is supplied through a fuel line 6 which is actually a pipe. The amount of air and fuel supplied to the combustion chamber 2 may be varied, depending on the demands placed upon the boiler A. To this end, the fan 4 discharges the air through a damper 8, whereas fuel line 6 contains a valve 10. By opening and closing the damper 8 and the valve 10 simultaniously, more or less air and fuel enter the combustion chamber 2, and of course the amount of heat produced is commensurate with the amount of fuel consumed, assuming the combustion occurs under near optimum conditions. The damper 8 and valve 10 are connected to and operated by a single modulating motor 12, and it in turn is sensitive to conditions within the boiler A itself. For example, the modulating motor 12 may be under the control of a thermostat located within the boiler A or a pressure sensor in a steam line. In any event, the motor 12 responds to conditions within the boiler A, and by controlling the amount of air and fuel delivered to the combustion chamber 2, it seeks to maintain a preselected condition of temperature or pressure.

Considering the modulating motor 12 in more detail, it includes (FIG. 1) a housing 16 which is fastened to the face of the boiler A and a rotatable stub shaft 18 which projects from the housing 16. If the monitored condition within the boiler A falls below the preselected magnitude, the motor 12 rotates the shaft 18 in one direction, and if the monitored condition exceeds the preselected magnitude, the motor 12 rotates the shaft 18 in the opposite direction. The shaft 18 carries a crank arm 20, which is coupled to it with a set screw so that the inclination of the arm 10 with respect to the housing 16 may be adjusted. The air damper 8 likewise has a crank arm 22 mounted on a shaft 24 which, when rotated, varies the amount of air admitted to the combustion chamber 2. When the shaft 24 is rotated in one direction, more air from the fan 4 is admitted, and when rotated in the opposite direction, less air is admitted. The crank arm 20 of the modulating motor 12 is connected to the crank arm 22 of the air damper 8 through a damper rod 26, there being a pivot-type coupling 28 at each end of the rod 26 for enabling it to pivot relative to the crank arms 20 and 22. The coupling 28 at the crank arm 20 is, of course, located remote from the shaft 18 of the motor 12, so rotation of the stub shaft 18 imparts translation to the rod 24, and likewise the coupling 28 at the crank arm 22 for the damper 8 is located outwardly from the shaft 24 for the damper 8, so that the translation of the rod 24 is converted into rotation of the shaft 24. This varies the amount of air admitted to the combustion chamber 2.

The stub shaft 18 carries another crank arm 32 (FIG. 1) which is likewise secured to it with a set screw, so that the arm 32 can be rotated to a suitable angle and then rendered fast on the shaft 18. The crank arm 32 has a valve rod 34 connected to it with another pivot-type coupling 28, that coupling being located remote from the shaft 18 so that rotation of the shaft 18 will impart translation to the rod 34. At its opposite end the rod 34 is connected to a control device B, which converts the translation of the rod 34 into movements which operate the valve 10, relating the amount of fuel admitted to the combustion chamber 2 by the valve 10 to the amount of air admitted by the damper 8, so that a precise correlation between the fuel and air exists over a wide variation of heat demands imposed on the boiler A.

The fuel valve 10 is quite conventional. Where the fuel is a combustible gas, it is preferably a so-called butterfly valve interposed in the fuel line 6. As such, it includes (FIGS. 2 and 3) a body 38 which is somewhat cylindrical in configuration and has internal threads at its ends. Indeed, the pipe which constitutes the fuel line 6 is interruped at the valve 10, and here the pipe is threaded into the internal threads of the body 38 so that the body 38, which is hollow, in effect forms part of the fuel line 6. In the region between its internal threads, the valve body 38 is fitted with a shaft 40 which passes through the hollow interior of the body 38 and projects beyond one side of the body 38. The shaft 40 is free to rotate in the body 38, and within the hollow interior of the body 38, it in turn is fitted with a modulating plate 42 (FIG. 2) which is large enough to extend across and substantially block the hollow interior, assuming of course that it is rotated to the proper position. That rotation is imparted by the shaft 40. Thus, by rotating the shaft 40, the modulating plate 42 can be moved between open and closed positions. In the former it lies along the longitudinal axis of the valve body 38 and presents a minimal obstruction to the flow of fuel in the line 6; in the latter it extends across the hollow interior of the body 38 and throttles the flow of fuel. The control device B rotates the shaft 40 of the valve 10, moving it to and holding it in positions which match the gas flow in the line 6 to the flow of air through the damper 8 in the sense that the two flows when mixed produce the most efficient combustion.

The control device B lies along the fuel line 6 in the region of valve 10 (FIG. 2–5). Indeed, its components are mounted on both the pipe of the fuel line 6 and the shaft 40 of the valve 10. The latter consititutes nothing more than a control arm 46 which at one end fits around the shaft 40 of the valve 10 and is fastened to that shaft with a set screw 48, so that its position with respect to the modulating plate 42 may be altered. Generally midway between its ends, the arm 46 is fitted with an axle 50 which projects away from the valve body 38, with its axis being parallel to the axis of the shaft 40. The axle 50 serves as a journal for a roller 52 which revolves on the axle 50. The opposite of the arm 46 carries a pin 54 which projects away from the roller 52, that is from the opposite face of the arm 46.

Among the remaining components of the control device B, that is the components which are carried on the fuel line 6, are a clamp 58 (FIG. 2–5) which fits around the pipe of the fuel line 6 adjacent to the valve 10, a cam 60 which rotates on the clamp 58, and an operating arm 62 which is attached to the cam 60. The operating arm 62 is connected to the valve rod 34 such that translation of the rod 34 imparts rotation to the cam 60. The roller 52 on the control arm 46 of the valve 10 bears against and follows the cam 60, so that rotation of the cam 60 changes the position of the modulating plate 42 within the hollow interior of the valve body 38.

The clamp 58 includes a bracket 64 (FIGS. 3 and 4) of U-shaped cross-sectional configuration, and the two legs of this bracket have concave edges which match the contour of the pipe for the fuel line 6. The concave edges fit against that pipe adjacent to the valve 10, beyond either the upstream or downstream end of the valve body 38, whichever lends itself to the greater convenience. The bight portion of the bracket 64 has a spindle 66 (FIGS. 4 and 5) projecting from it parallel to the shaft 40 of the valve 10, and the spindle 66 serves as a journal for the cam 60 which rotates backwardly and forwardly on it. In addition, the clamp 58 has a U-bolt 68 (FIG. 4), the bight portion of which is curved to match the contour of the pipe that forms the fuel line 6. The curved bight portion of the U-bolt 68 fits along one side of the pipe and the bracket 64 or the other, and indeed the legs of the U-bolt 68 fit through the bight portion of the bracket 64, beyond which nuts 70 are threaded over them to secure the bracket 64 and U-bolt 68 firmly to the pipe. Thus, the clamp 58 serves to position the spindle 66, on which the cam 60 rotates, next to the valve 10 with the spindle 66 parallel to the shaft 40 of the valve 10.

Figure 2:
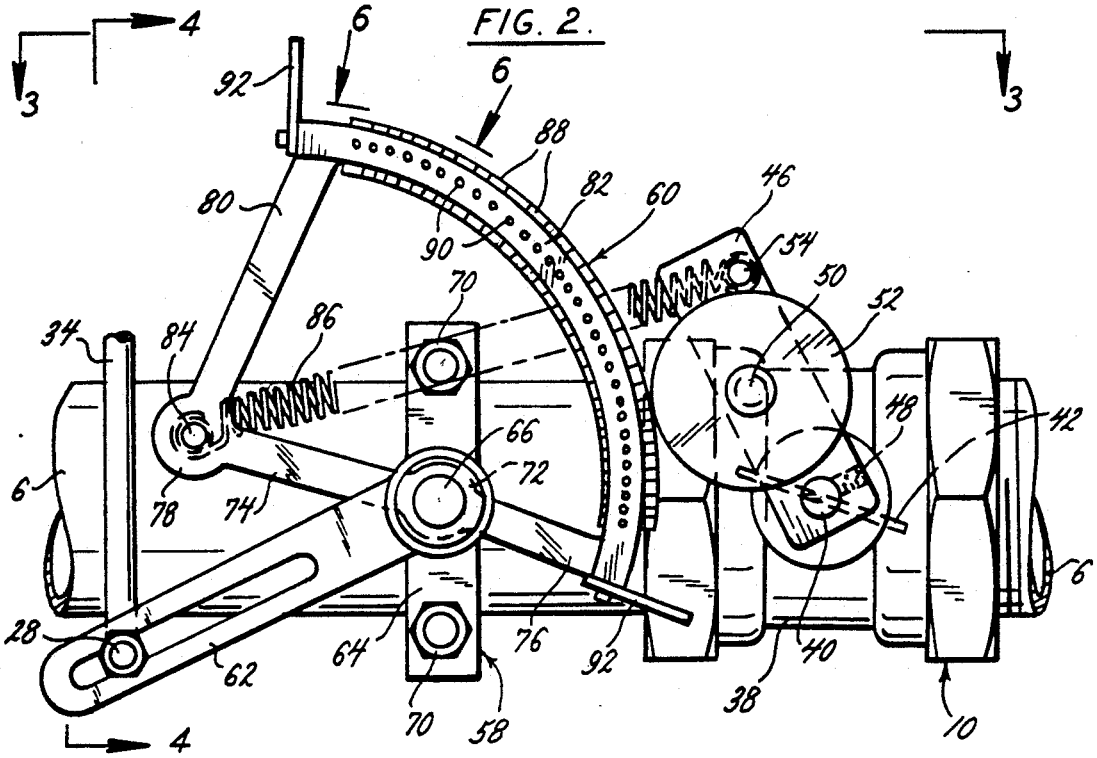
FIG. 2 is an enlarged elevational view of the control device mounted on a fuel line adjacent to a valve in that line.
Figure 3:
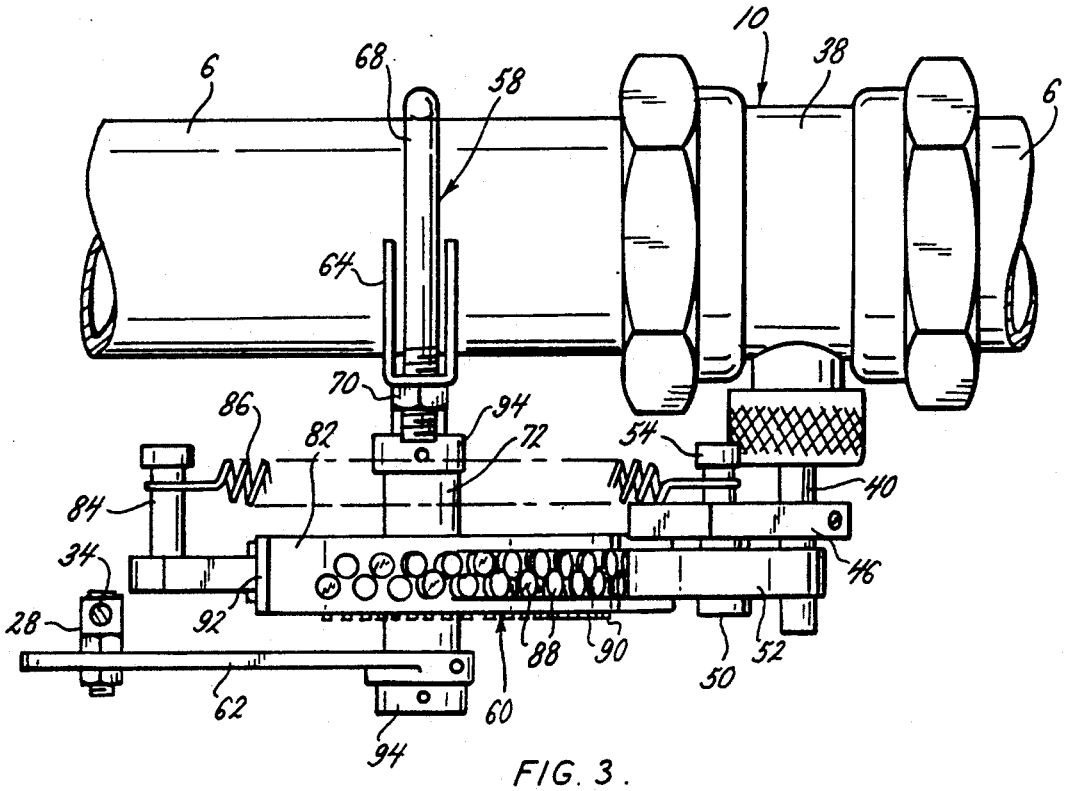
FIG. 3 is a plan view of the control device, fuel line, and valve taken along line 3—3 of FIG. 2.
Figure 4:
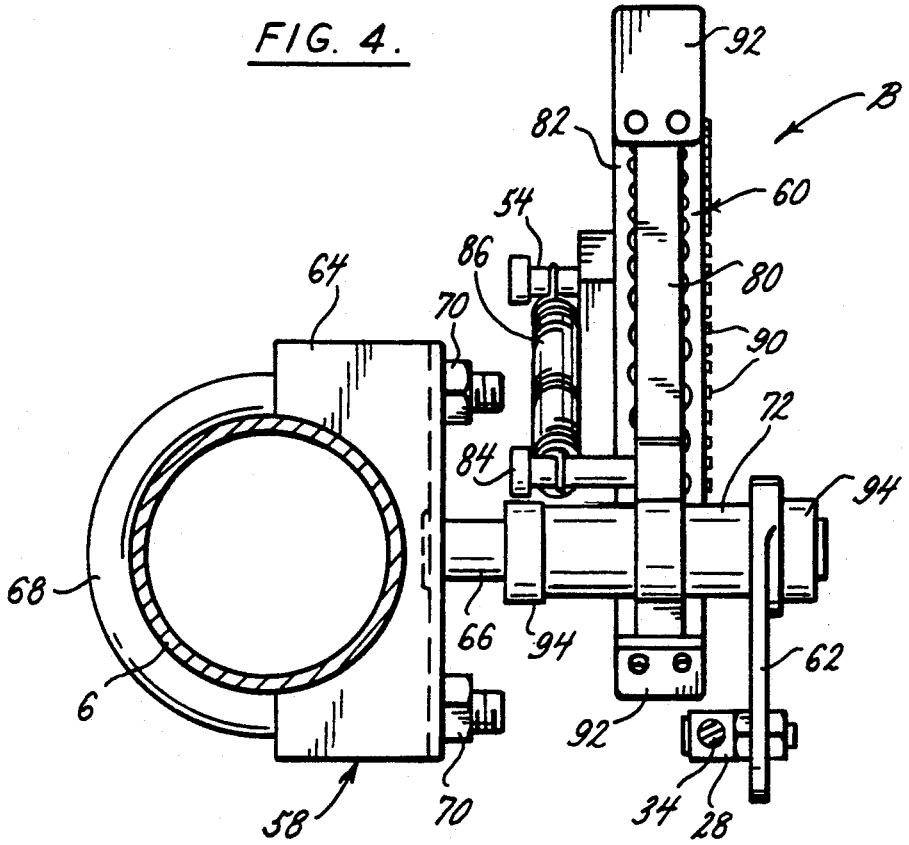
FIG. 4 is an elevational view of the control device taken along line 4—4 of FIG. 2.

The cam 60, which is preferably cast as an integral unit from a metal such as brass, includes a bushing 72 (FIGS. 3–5) which fits over and rotates on the spindle 66. In addition, the cam 60 has a pair of legs 74 and 76 which radiate from the bushing 72, midway between its ends, at about 180° with respect to each other. The leg 74 terminates at circular connecting segment 78 and here the leg 74 merges into another leg 80 oriented generally perpendicular to the leg 74. Extended between the opposite ends of the legs 74 and 80 is an arcuate segment or element 82, the major surfaces areas of which lie parallel to the bushing 72 and spindle 66, yet the element 82 is eccentric to the bushing 72 (FIG. 2). By reason of this eccentricity, the spacing between the element 82 and the shaft 40 of the valve 10 varies as the cam 60 rotates on the spindle 66. The arcuate element 82 aligns with the roller 52 on the control arm 46 that extends from the shaft 40 of the valve 10, but is narrow enough to avoid interferring with the fuel line 6, valve 10, and even the arm 46 on the valve 10. Indeed, the arm 46 is offset from the element 76, and the legs 74, 76 and 80 as well, so that it can pass to the side of then (FIG. 3). At the circular segment 78 where the two legs 74 and 80 meet at right angles, the cam 60 is fitted with a pin 84 which projects toward the pipe and lies parallel to the spindle 66—and the pin 54 on the control arm 46 as well. Indeed, the two pins 54 and 84 anchor the ends of a coil-type tension spring 86 which urges the connected legs 74 and 80 toward roller 52 and thereby imparts a torque to the cam 60.

Figure 6:
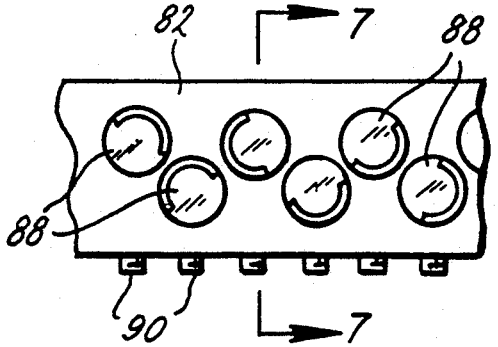
FIG. 6 is a fragmentary plan view of the cam on the control device.
Figure 7:
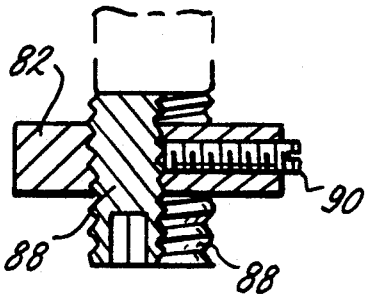
FIG. 7 is a sectional view of the cam taken along line 7—7 of FIG. 6.

While the roller 54 aligns with the flange 76, it does not actually contact the flange 76, but instead bears against the ends of cam screws 78 (FIGS. 2 and 3) which are threaded through the element 82 along radii emanating from the center of curvature for the element 82. The screws 88 lie in two rows, and these rows together are about as wide as the roller 52 (FIG. 3). Indeed, the roller 52 aligns with the two rows of screws 88, so that it rides over the ends of the screws 88 in both rows, it being held against the ends of the screws 88 by the tension spring roller 86. The screws 88 of the two rows are staggered with respect to each other (FIG. 6). Moreover, in either row, the spacing between adjacent screws 88 does not exceed the diameter of the screws 88, so by reason of the offset or stagger, the ends of the screws 88 form a generally continuous camming surface or profile on the cam 60. The roller 52 follows this profile when the cam 60 rotates on the spindle 66, all without experiencing pulsations, that is, without undergoing drops between adjacent screws 78, and thus the roller 52 serves as a cam follower. Since the arcuate element 82 of the cam 60 is eccentric to the spindle 66, the roller 52 will move toward and away from the spindle 66 with rotation of the cam 60, depending on the direction of rotation, and this changes the position of the control arm 46—and likewise the position of the modulating plate 42 within the valve body 38. Each cam screw 88 at its inner end has a hexagonal socket where the screw may be engaged with a wrench and rotated to thereby change the extent to which it projects beyond the outside face of the arcuate element 82. The outer ends of the screws 88 are flat or slightly domed so as to maintain the continuity of the profile formed by those ends, although each may have a slight bevel along its periphery. Each screw 88 is stabilized by a smaller set screw 90 (FIG. 7) which threads into the arcuate element 82 from one of its side edges, and indeed the set screw 90 is turned down against the side of the cam screw 88. The set screws 90, of course, may be backed off from their respective cam screws 88, and when so retracted, the cam screws 88 may be turned to change the profile of the cam 60.

At each of its ends the arcuate element 82 is fitted with a stop plate 92 (FIG. 2) which projects radially beyond the outer ends of the cam screws 88. The arrangement is such that the roller 52 upon riding onto the last cam screw 88 at either end of the cam 60 will simultaneously come against the stop plate 92 at that end. In short, the stop plates 92 prevent the roller 52 from rolling beyond the last cam screws 88 and off of the cam profile formed by the two rows of screws 88.

The spindle 66 of the clamp 58 also carries two collars 94 which are secured firmly in place with set screws 98 —one at each end of the bushing 72 for the cam 60—and indeed the cam bushing 72 is captured between the two collars 94. Thus, while the cam 60 will rotate on the spindle 66, it cannot shift axially on spindle 66. The roller 54 is urged against the cam profile of the cam 60, that is the ends of the cam screws 88, by the coil-type tension spring 86 (FIGS. 2–4) which extends between the pin 54 on the control arm 46 and the pin 84 on the circular connecting segment 78 of the cam 60. As a consequence, the roller 52 remains against the profile of the cam 60, irrespective of the angular position of the cam 60.

The operating arm 62 of the control device B fits around the bushing 72 and projects radially from it and the spindle 66 (FIGS. 2 and 3). Indeed, it is secured to the bushing 72 with a set screw 98, so that its angular position with respect to the cam 60 may be altered to suit the particular location in which it is placed, and then rendered secure. Indeed, the operating arm 62, remote from the bushing 72, is connected to the valve rod 34 through another pivot-type coupling 28.

The orientation of the crank arms 20 and 32 with respect to the stub shaft 18 of the modulating motor 12, the orientation of the crank arm 22 with respect to the damper 8, the orientation of the operating arm 62 with respect to the cam 60, the locations at which the damper rod 26 is connected to the crank arms 20 and 22, and the locations at which the valve rod 34 is connected to the crank arm 32 and operating arm 62, are all such that that roller 52 will pass from one end of the profile for the cam 60 to the other end as the damper 8 changes from its most restricted position to its fully open position. Thus, when the damper 8 is in its most restricted position, the roller 52 will be at that end of the cam profile where the modulating plate 42 lies across the interior of the valve body 38 and substantially reduces the flow of fuel. On the other hand, when the damper 8 is in its fully open position, the roller 52 will be at the other end of the cam profile where the modulating plate 42 lies parallel to the direction of flow for fuel through the valve body 38, so that the maximum flow of air is accompanied by a maximum flow of fuel. At each of these positions, the flue gases from the boiler A are analyzed to determine the quality of the combustion in the combustion chamber 2. The flow of fuel at each position is adjusted bring the combustion to the desired state, this being achieved by rotating the cam screw 88 that is beneath the roller 52 for that positions of the cam 60. The same adjustments are made for many intermedite positions for the cam 60.

This invention is intended to cover all changes and modifications of the example of the invention herein chosen for purposes of the disclosure which do not constitute departures from the spirit and scope of the invention.

What is claimed is:

1. In combination with a damper through which air is admitted to a combustion chamber and which opens and closes to modulate the air so admitted, a fuel line through which a fluent fuel is admitted to the combustion chamber, a valve located in the fuel line and having a rotatable shaft which, when turned, opens and closes the valve to thereby cause the amount of fuel passing through the valve and fuel line to vary, and modulating means for opening and closing the damper and valve in unison in response to conditions that are dependent on the combustion within the combustion chamber, an improved control device for connecting the modulating means with the valve, said control device comprising: a control arm connected to the shaft of the valve; a cam follower on the control arm; a bracket mounted firmly on the fuel line adjacent to the valve and having mounting means for establishing an axis of rotation that is parallel to the shaft of the valve; a cam mounted on the mounting means adjacent to the control arm for rotation about the axis of rotation and being connected to the modulating means, so that the modulating means causes the cam to rotate in response to conditions that are dependent on the combustion with the combustion chamber, the cam having an arcuate segment which curves about the axis of rotation and also screws arranged in at least one row that follows the curvature of the arcuate segment about the axis of rotation, the screws projecting generally away from the axis or rotation and beyond the arcuate segment and having their outer ends exposed to establish a cam profile which varies in distance from the axis of rotation, the follower being against the profile; and a tension spring connected between the control arm and the cam for urging the cam follower against the cam profile; whereby as the cam is rotated by the modulating means, the profile moves the follower and the follower moves the control arm to rotate the shaft of the valve so as to vary the amount of fuel passing through the fuel line and whereby the cam profile may be altered by rotating the screws.

2. The combination according to claim 1 wherein the follower is a roller.

3. The combination according to claim 1 wherein the control arm is offset with respect to the cam and the follower is a roller.

4. The combination according to claim 1 wherein the cam includes a web which projects outwardly from the axis of rotation for the cam and the arcuate segment is attached to the web and curves about the axis with its convex surface being presented away from the axis.

5. The combination according to claim 1 wherein the screws are arranged in at least two rows, with the screws of the one row being staggered with respect to the screws of the other row.

6. The combination according to claim 5 wherein the spaces between adjacent screws in either row do not exceed the diameter of the screws.

7. The combination according to claim 5 wherein the cam follower is a roller that revolves about an axis that is fixed in position with respect to the control arm and is parallel to the axis of the shaft on the valve.

8. The combination according to claim 7 wherein the roller is long enough to extend across both rows of screws and contacts screws in both rows.

9. The combination according to claim 1 wherein the cam further includes stops mounted on the arcuate segment beyond the ends of the rows of screws and projecting outwardly beyond the cam profile to interfere with the follower and prevent further rotation of the cam when the follower is at either end of the rows of screws.

10. The combination according to claim 1 wherein the tension spring is connected to the cam at a location remote from the axis of rotation, and the axis of rotation is located between the location at which the spring is connected and the arcuate segment.

11. In combination with a fuel line and a valve located in the fuel line for varying the flow of fuel through the line, the valve having a rotatable shaft which, when turned, varies the amount of fuel that flows through the line and valve, a control device for operating the valve, said control device comprising: a bracket having a spindle projecting from it; means for attaching the bracket firmly to the fuel line near the valve with the spindle parallel to the shaft of the valve; a cam mounted on the spindle of the bracket for rotation back and forth about the axis of the spindle, the cam having an arcuate segment that curves about the spindle and set screws which are threaded into the arcuate segment where they are arranged in two adjacent rows that follow the curvature of the arcuate segment, the set screws of the one row being staggered with respect to the set screws of the other row, the set screws projecting outwardly beyond the arcuate segment such that their ends form the profile for the cam; a control arm attached firmly to the shaft of the valve and projecting generally radially from that shaft; a follower carried by the control arm and bearing against the ends of at least some of the screws for the cam, the follower being a roller which rotates on the control arm about an axis that is parallel to the axis of the spindle for the bracket and parallel to the shaft of the valve; the cam and follower being oriented and positioned such that rotation of the cam about the spindle of the bracket will move the follower relative to the spindle and likewise move the control arm to thereby rotate the shaft of the valve; and a tension spring connected to the control arm and the cam for urging the roller follower against the ends of the screws on the cam.

12. The combination according to claim 11 wherein the spaced between adjacent screws of either row does not exceed the diameter of the screws.

13. The combination according to claim 11 wherein the cam further includes stops mounted on the arcuate segment beyond the ends of the rows of screws and projecting outwardly beyond the cam profile formed by the ends of the screws to interfere with the follower and prevent further rotation of the cam when the follower is at either end of the rows of screws.

14. The combination according to claim 11 wherein the spring is connected to the cam at a location beyond the spindle so that the spindle is generally between the arcuate segment and the location at which the spring is connected.

15. The combination according to claim 11 and further comprising an operating arm connected to the cam at the spindle for connecting the cam to an operating motor and being adjustable with respect to the cam about the axis of the spindle.

* * * * *